US006958032B1

(12) United States Patent
Smith

(10) Patent No.: US 6,958,032 B1
(45) Date of Patent: Oct. 25, 2005

(54) RESISTIVE EXERCISE DEVICE

(75) Inventor: Damon C. Smith, deceased, late of League City, TX (US); by Gail Smith, legal representative, League City, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 462 days.

(21) Appl. No.: 10/263,288

(22) Filed: Sep. 26, 2002

(51) Int. Cl.[7] ..... A63B 21/00
(52) U.S. Cl. ..... 482/121; 482/126
(58) Field of Search ..... 482/70, 51, 71, 482/140, 142, 121–130

(56) References Cited

U.S. PATENT DOCUMENTS 4,351,523 A * 9/1982 Alexander ..... 482/123
4,482,149 A * 11/1984 Weldon ..... 482/130
4,944,511 A 7/1990 Francis
5,509,870 A 4/1996 Lloyd
5,637,066 A * 6/1997 Chang ..... 482/126
5,653,667 A * 8/1997 Reyes ..... 482/121
5,685,811 A 11/1997 McShane et al.
5,839,997 A 11/1998 Roth et al.
5,898,111 A 4/1999 Blankenship et al.
D414,228 S 9/1999 Zwonitzer
5,971,899 A 10/1999 Towley, III et al.
6,117,049 A 9/2000 Lowe
6,120,423 A 9/2000 Mackey et al.
6,126,580 A 10/2000 Francis et al.

* cited by examiner

*Primary Examiner*—Jerome W. Donnelly
(74) *Attorney, Agent, or Firm*—Theodore U. Ro

(57) ABSTRACT

An exercise device 10 is particularly well suited for use in low gravity environments, and includes a frame 12 with plurality of resistance elements 30, 82 supported in parallel on the frame. A load transfer member 20 is moveable relative to the frame for transferring the applied force to the free end of each captured resistance element. Load selection template 14 is removably secured both to the load transfer member, and a plurality of capture mechanisms engage the free end of corresponding resistance elements. The force applying mechanism 53 may be a handle, harness or other user interface for applying a force to move the load transfer member.

31 Claims, 10 Drawing Sheets

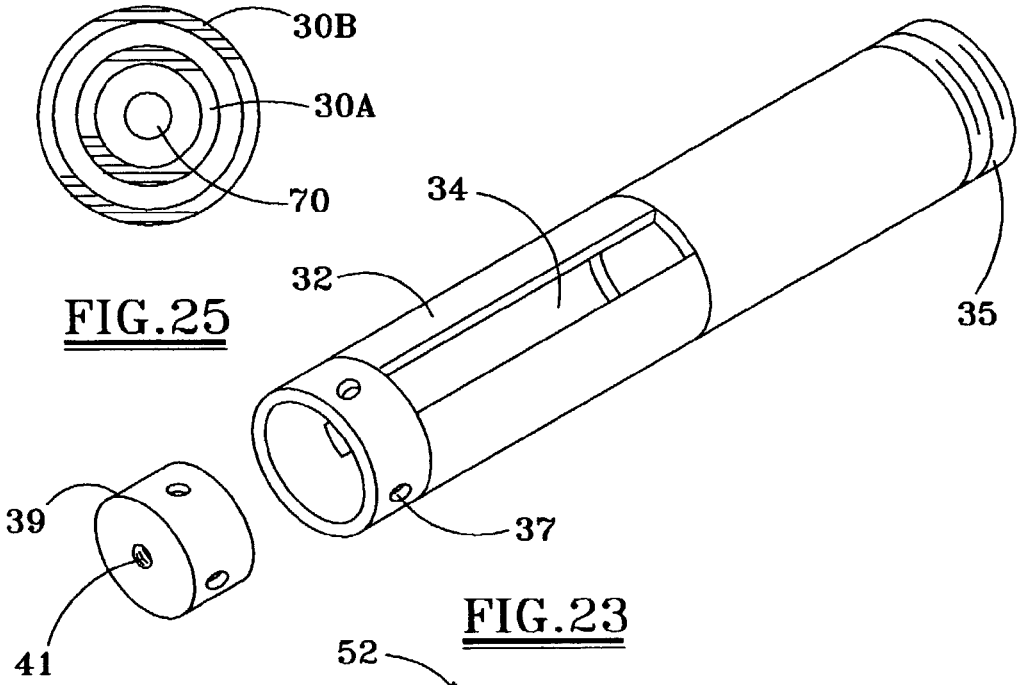
FIG.25
FIG.23
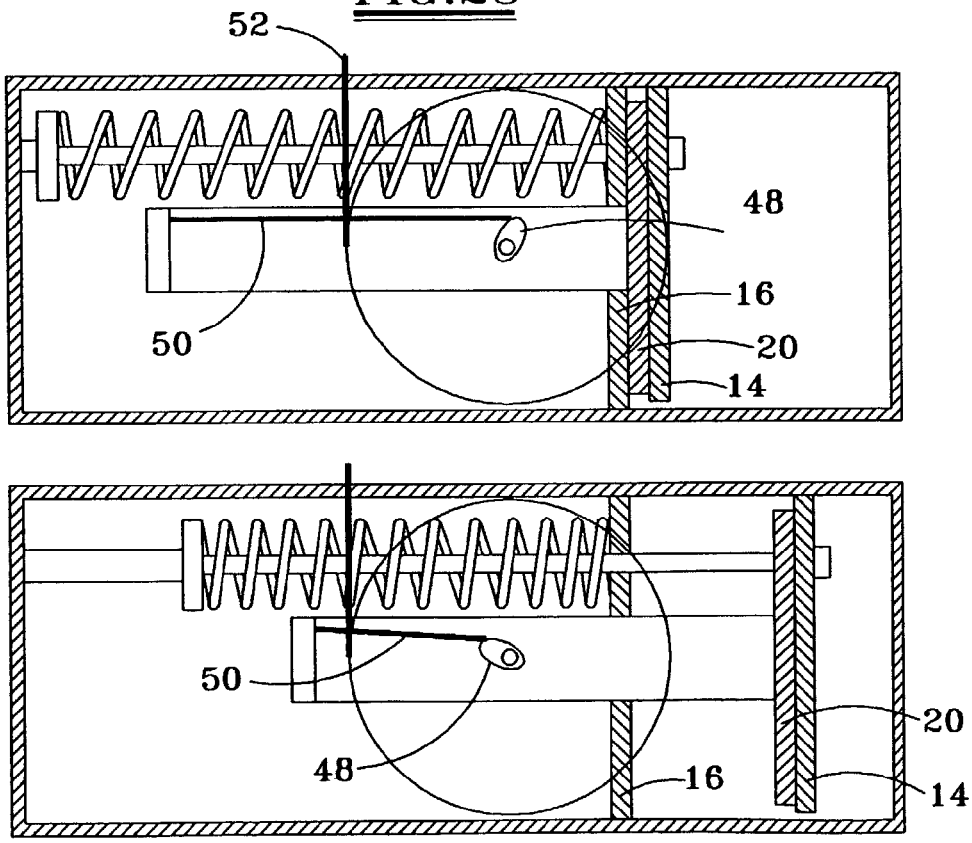
FIG.24

RESISTIVE EXERCISE DEVICE

FIELD

The present apparatus relates to exercise devices and, more particularly, to an exercise device intended for use by individuals in a low-gravity environment.

BACKGROUND

People exposed to low-gravity environments during space travel are prone to losing bone density and muscle mass resulting from decreased resistance during ordinary movements. Astronauts on a space station do not need to support their full weight as they would while walking on Earth. Resistance training on Earth is an approach to minimizing the de-conditioning effects of space travel. While resistance training on Earth is beneficial and healthful to humans, such training in space is also important in low-gravity (less than Earth's gravity) environments for maintaining health and fitness. Many inventors have addressed the need for resistance training, and some devices are particularly intended for use in microgravity environments.

The International Space Station provides physical exercise equipment for its astronauts/cosmonauts to counter the de-conditioning effects of prolonged exposure to microgravity. One device, known as the Treadmill with Vibration Isolation and Stabilization (TVIS), provides walking, running, and deep knee-bending exercises. Another device known as the Resistive Exercise Device (RED) is designed to simulate weight lifting on Earth. A resistance force is coupled between the user and the equipment.

Ideally, exercise equipment for use in space should closely approximate the effects of gravity on Earth. Earth's gravity provides an essentially constant amount of weight (force) to a given mass. Consequently, a runner's legs would weigh the same throughout the running motion. Free weights, which are among the best source of resistance training on Earth, can provide a constant level of resistance throughout a range of movements as a result of gravity, i.e., a weight lifted one inch off a surface on Earth exerts the same constant force when the weight is lifted 20 inches off the surface. By contrast, machines which generate forces through spring-type resistance elements typically do not provide the constant force through displacement characteristic of free weights, and are often poor at duplicating the effects of gravity.

Without simulating the effects of gravity, exercise equipment in space may lead to possible distortion of body movements by exposing users to resistive forces unlike those experienced on Earth. For example, simulated treadmill running in space using a non-uniform resistance would train the body differently than would running while on Earth. Space travelers might therefore have problems readjusting to their normal routines on Earth. The exercise equipment ideally would provide the same force in space which the user would experience by a constant weight force on Earth, regardless of how the user moves, and thus behave like free weights on Earth, over a range of motion.

Although free weights are beneficial on Earth, they do not "weigh" anything in zero gravity environments. Free weights are not even practical for space travel to low gravity environments, such as the moon, because their size and weight would be too taxing on the payload. U.S. Pat. No. 4,944,511 discloses exercise equipment intended to address the inherent drawbacks of free weights by using resistance elements. However, this device suffers from the shortcomings discussed above related to the use of the equipment.

U.S. Pat. No. 6,126,580 discloses an exercise device for use in micro-gravity environments. The device uses resistive elements whose level of resistance increases with displacement. To counteract this increasing resistance, the device incorporates a pulley having a progressively increasing diameter, thus increasing the leverage acting against the resistance element.

U.S. Pat. No. 6,120,423 also addresses the need for exercise equipment in space to compensate for the constant force displacement characteristic of free weights on Earth. "Constant force" springs are used. This equipment also suffers from the shortcomings of other exercise machines. The size and weight of payloads in space travel are crucial, because they directly influence factors such as fuel consumption and spatial limitations. Payload items in space travel, such as exercise devices, must be designed to minimize both size and weight.

Another limitation of prior art exercise devices is the mechanism for selecting and adjusting the level of resistance for a particular user. With free weights used on Earth, selecting a level of resistance may include the simple task of interchanging a number of weights between a piece of equipment and a storage rack. Exercise equipment in space ideally may be used by various individuals with different strengths, and each individual also preferably may easily alter the force (energy) required to move over a particular range of motion.

Machines using alternatives to free weights incorporate a number of methods for selecting and varying resistance. U.S. Pat. No. 6,117,409 discloses the use of a screw mechanism for adding or subtracting plates from a stack. U.S. Pat. No. 6,120,423 proposes a plurality of sockets for receiving adjustable, detachable resistance mechanisms. U.S. Pat. No. 4,944,511 describes the use of a resistance element having an adjustable level of tension. Other patents of interest include U.S. Pat. Nos. 5,509,870, 5,685,811, 5,839,997, 5,898,111, 5,971,899, and 6,117,049. These prior art techniques do not adequately satisfy the rigorous requirements for exercise equipment to be used in low gravity environments.

The present apparatus surpasses the prior art, offering an improved exercise device for use in various environments, and particularly a low gravity environment. The exercise device closely duplicates the effects of gravity, and is easily adjusted. The exercise equipment is easily adjusted for a predetermined amount of restrictive forces, and is also highly efficient in terms of spatial and weight limitations for space travel.

SUMMARY

The present apparatus provides a resistive exercise device including a frame, one or more resistance elements supported on the frame, each resistant element having a supported end attached to the frame and a free end opposite the supported end and moveable in response to applied force by a user, and a load transfer member transferring the applied force to the free end of the one or more resistance elements.

In one embodiment, a load selection template is removeably secured to the load transfer member and has a plurality of capture mechanisms. Each selected capture mechanism engages the free end of the corresponding resistance element, such that the applied force to the load transfer member moves the load transfer member to displace the free end of each engaged resistance element. A conventional force applying mechanism, such as a pair of gripping handles, may be used to apply the applied force to the load transfer member to move the load transfer member.

In another embodiment, a flexible elongate member, such as a cable, is coupled with a cam, such that the applied force to the cable rotates the cam to move the load transfer member. The profile of the cam negates an increasing force of the resistance elements and maintains a relatively constant tensile force on the flexible elongate member through a range of displacements of the free end of the resistance elements.

It is a feature of the present apparatus that each of the plurality of resistance elements is a linear resistance element whose force increases substantially linearly over displacement range of the free end relative to the fixed end. Each of the plurality of resistance elements may be a coil spring, and the applied force may compress the springs.

Another feature of the apparatus is that the force applying mechanism may include a pulley having a stationary axis with respect to the frame, an elongate flexible member, such as a cable, coupled with a pulley and secured to the load transfer member, and a user interface secured to the elongate flexible member for engagement by the user to provide the applied force to the force applying mechanism. The pulley may have a helical shape to accommodate multiple revolutions of the cable. In an embodiment, the flexible elongate member may then be coupled with a cam, such that the applied force to the cable rotates the cam to move the load transfer member. The pulley radius is preferably at least twice a maximum radius of the cam profile.

It is another feature of the present apparatus that one or more of the plurality of resistance elements may be nested in another of the plurality of resistance elements, thereby conserving space.

In another embodiment, each of a plurality of resistance elements may be a piston displaced by substantially constant force over a range of displacement.

Another feature of the apparatus is that the resistive exercise device may include a stroke rod secured to the free end of each resistance element, with the stroke rod having a cap end for capture by the capture mechanism and a neck region substantially narrower than the cap end. In an embodiment, each capture mechanism comprises opposing tabs having a spacing wider than the neck region and narrower than the cap region of the stroke rod, such that the opposing tabs engage the cap end of the corresponding stroke rod.

Each of a plurality of resistance elements may also be preloaded between opposing ends of the resistance element.

Another feature of the apparatus is the resistance exercise device may be interfaced with another piece of exercising equipment, such that the applied force by the user is transmitted through another piece of exercise equipment and then to the resistive exercise device.

Yet another feature of the apparatus is that the resistive exercise device may be provided with a plurality of differently sized and interchangeable cams, each cam providing a corresponding level of constant force displacement to operate the resistive exercise device.

Another feature of the present apparatus is that the exercise equipment may exert a substantially constant load on the user over a range of motion when operating in a low gravity or zero gravity environment.

A further feature of the apparatus is that the exercise device may be used with other exercise equipment, such as a treadmill.

As yet another feature of the apparatus, the exercise equipment provides a selectable and constant load throughout outward and return portions of a stroke.

Yet another feature of the apparatus is that the exercise device may incorporate a motor to provide augmentation so that the load during inward movement is higher than the load during outward movement.

A significant advantage of the apparatus is that the exercise equipment is relatively simple and thus highly reliable, and is also relatively compact and lightweight.

A further advantage of the apparatus is that the exercise equipment may be easily altered for supplying a varying load to the equipment depending upon the ability and desire of the user.

These and further objects, features, and advantages of the present apparatus will become apparent from the following detailed description, wherein reference is made to the figures in the accompanying drawings.

BRIEF DESCRIPTION OF THE DRAWINGS

FIG. 23 is a pictorial view of the slotted spring support tube.

FIG. 24 depicts a resistive exercise device with a single spring shown for clarity in the relaxed position and in the stroked position.

FIG. 25 depicts a nested spring arrangement.

DETAILED DESCRIPTION OF EMBODIMENTS

The International Space Station provides physical exercise hardware for its astronauts as a counter-measure against the de-conditioning effects of prolonged exposure to low gravity or microgravity environments. The equipment of this apparatus simulates gravity and exerts substantially the same coupling force regardless of how the person moves. The equipment provides a constant force independent of stroke velocity throughout the outward (extend) and inward (return) components of the stroke. The load devices are adjustable, so that the person can accurately and consistently select the amount of force to be exerted.

Figure 1:
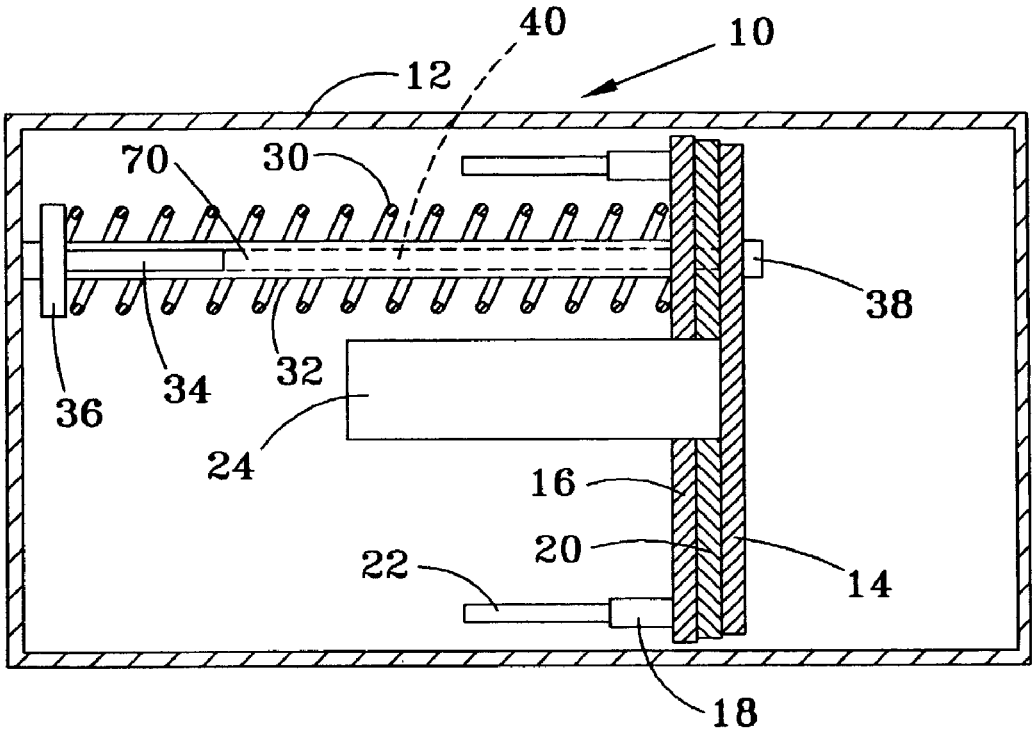
FIG. 1 simplistically depicts the primary components of one embodiment of an exercise device according to the present apparatus.
Figure 2:
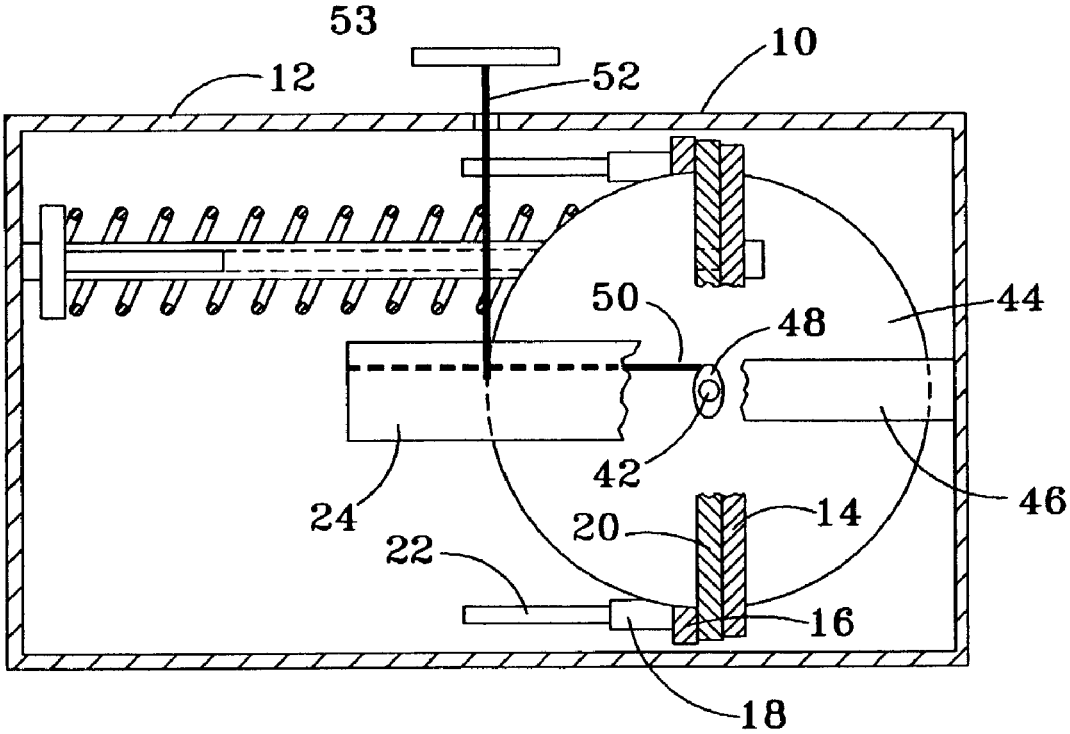
FIG. 2 is a simplified side view of another embodiment of an exercise device according to the present apparatus.

FIGS. 1 and 2 illustrate one embodiment of the equipment according to this apparatus. As disclosed further below, load selection is accomplished by the insertion of a load selection template 14 into a slot on the top of the enclosure 12, which is conveniently fixed to or is the exercise device frame. From four or more templates may be used. If no template is inserted, the load may be set at a minimum value, e.g., 10 lbs. The insertion of any template into the slot sets the load to the number, e.g., 20, 25, or 50 lbs, on the template label. All templates may be stored together in a compartment in the top of or within the enclosure. The method of load adjustment is simple, and similar to ground-based weight training systems in which a pin or key is inserted at a chosen point along an array of stacked weights. A typical stroke, e.g., for the load cable, for the equipment may be twenty inches.

The exercise device shown in FIGS. 1 and 2 include a base plate 16, which is conveniently bolted to the side walls of the enclosure 12. A load plate 20 moves with the stroke away from the base plate. Pairs of linear bearings 18 guide the load plate rods 22 which are fixed to the load plate 20. The bearings 18 may be bolted or otherwise secured to the base plate 16. The load plate 20 includes a load extension plate 24 which is fixed to the load plate and is shown more clearly in other figures.

A preloaded compression spring 30 is provided about a spring support tube 32 which includes one or more slots 34. A spring stroke cap 36 is provided at the free end of each spring 30. A spring stroke rod 40 as shown in FIG. 1 is positioned within the spring 30, and capture cap 38 secured to the stroke rod 40 is engaged or disengaged from the load selection template 14, as explained further below. Typically four more springs are provided on the equipment uniformly distribute the forces about the load plate. The load selection template 14 thus determines the number of capture caps 38 being engaged to move with the load plate 20, thereby further tensioning or compressing the coil springs 30.

Figure 5:
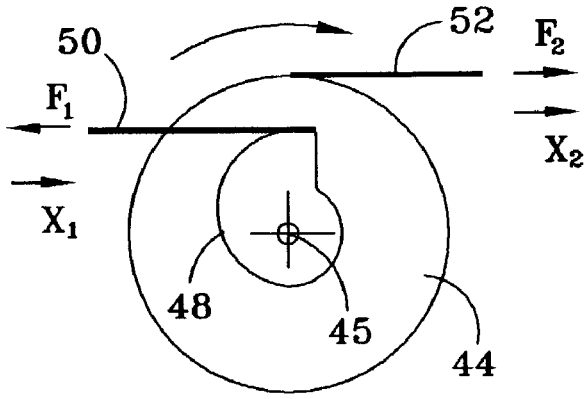
FIG. 5 more clearly depicts the forces acting on the cam and the large diameter portion of the shaft shown in FIG. 4.

FIG. 2 discloses alternative exercise equipment 10 with the load plate 20 and a load selection template 14 being broken away to illustrate one of the pair of lanyard wheel bearings 42 radially supporting lanyard wheel 44 on lanyard wheel bracket 46. The pulley axis 45 as shown in FIG. 5 is thus stationary with respect to the frame. Cam 48 is rotatably secured to the lanyard wheel, and cam cable 50 is conceptually shown for pulling on the load extension plate 24 during stroke of the equipment. Another flexible elongate member 52, such as a cable, is wrapped around the uniform diameter lanyard wheel 44 so that, in a FIG. 2 illustration, the user pulls upward on cable 52 which rotates the lanyard wheel 44 and thus the cam 48, thereby pulling cable 50 and moving the load plate during stroke by the user. FIG. 2 also shows a simplistic user interface 53 at the end of cable 52, such as a handle with one or more bars or other hand gripping members, or a harness or other member to be engaged and moved by the user, i.e., when using a treadmill. FIGS. 1 and 2 thus illustrate basic concept of a conceptual embodiment.

The equipment 10 as shown in FIGS. 1 and 2, which may be referred to as a Subject Load Device (SLD), may also be implemented as a Resistive Exercise Device (RED), which may be larger and have more load selection templates than the SLD. A typical RED may be capable of providing a load of 250 lbs and a stroke of 40 inches, thus having five times the energy storage of the SLD.

Design Considerations: The Force/Stroke Relationship for a Spring

The idealized case is obtained with a sustained constant load throughout the outward and return portions of the stroke, with the ability to accurately select the load. The objective is to closely approximate this performance, preferably without the use of motors or actuators, so that the only energy source being the muscle power of the person using the equipment.

The force versus stroke relationship when pulling a steel spring which is initially at its unloaded free length increase linearly with the stroke. The force is proportional to the stretch of the spring. The constant of proportionality is called the stiffness "K". The area under the force versus stroke graph is the mechanical work which has been put into the system during the outward portion of the stroke. The ability to return along the same force/stroke graph during the inward stroke component depends upon the return of this energy back to the user.

A graph depicting distortion of the force/stroke caused by friction is often referred to as the "hysteresis loop". Friction causes the person to pull harder during the outward movement so that the graph deviates above the linear relationship. During the return portion of the stroke, less force is exerted by the apparatus on the person, again due to friction, so this portion of the graph deviates below the linear relationship. The area inscribed by the hysteresis loop is the portion of mechanical energy which had been lost as heat.

Figure 3:
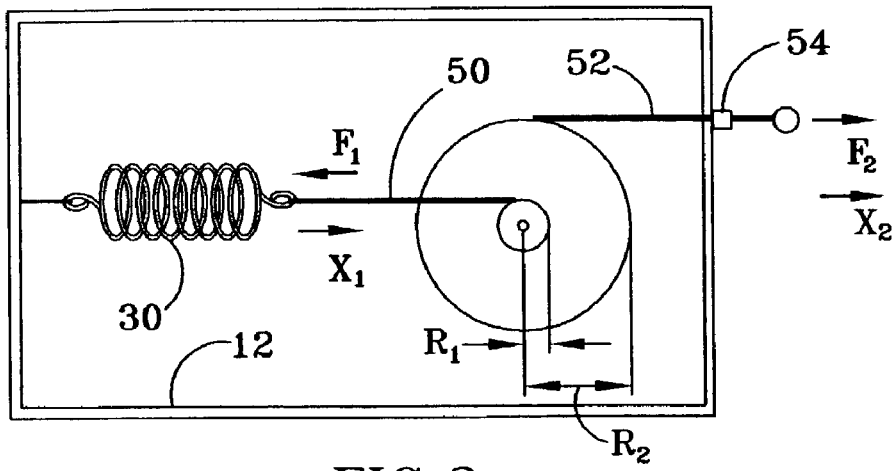
FIG. 3 depicts the forces acting on a cable wound about the shaft having a large diameter portion and a small diameter portion.

The effective stiffness of the spring can be modified using a compound drum having two different radii, as shown in FIG. 3. Equations 1, 2 and 3 listed below show the dependence of force and stroke on the ratio of the two radii. For a given stretch of the spring, the work stored is the same with or without the use of the compound drum. A mechanical stop 54 on the cable 50 engages the frame and serves to hold the initial position (zero stroke). The analogous device in the field of electronics is the passive transformer, in which the voltage versus current relationship (impedance) is altered, but the power remains the same (except for the losses).

Pre-Loading the Spring to Produce an Initial Force

The compound drum can reduce the slope of the force/stroke graph so that the effective stiffness $K_2$ is lower than the spring stiffness $K_1$, but the force still starts at zero at the beginning of the stroke. Instead of starting the stroke with the spring at its unloaded free length, the spring may be preloaded when it is installed. This pre-load is maintained by a mechanical stop 52 on the pulling cable 50, as shown in FIG. 3. The total work is now divided into a pre-load work term $W_{PRE}$ and a stroke work term $W_{ST}$. The force/stroke graph for $F_2$ now starts at an initial value determined by the spring pre-load force $F_{1PRE}$ and the ratio $R_1/R_2$. If this ratio is made small enough, the effective stiffness $K_2$ can be reduced to a very small number (see Equation 3). This will mean that the initial value of $F_2$ would not change significantly as the system is stroked and the device would approximate a constant load device. However, there are practical limitations on the smallness of the ratio of $R_1/R_2$ which generally preclude this approach in achieving constant force. If the ratio is extremely small, then $F_{1PRE}$ will have to be very large in order to get a reasonable initial value of $F_2$. The bearing on the compound drum would have to be quite large, and this increases bearing friction. Structural limitations on the bearing shaft and container also set an upper limit of $F_{1PRE}$ and thus a lower limit on $R_1/R_2$. Also, because the maximum value of $R_2$ is limited by dimensional constraints, $R_1$ would have to be very small to achieve the very small ratio of $R_1/R_2$. There is a minimum practical size for $R_1$ from the standpoint of minimum bearing shaft size and also the strain placed on the cable connecting the spring to the drum.

Use of a Cam to Hold a Constant Force

Figure 4:
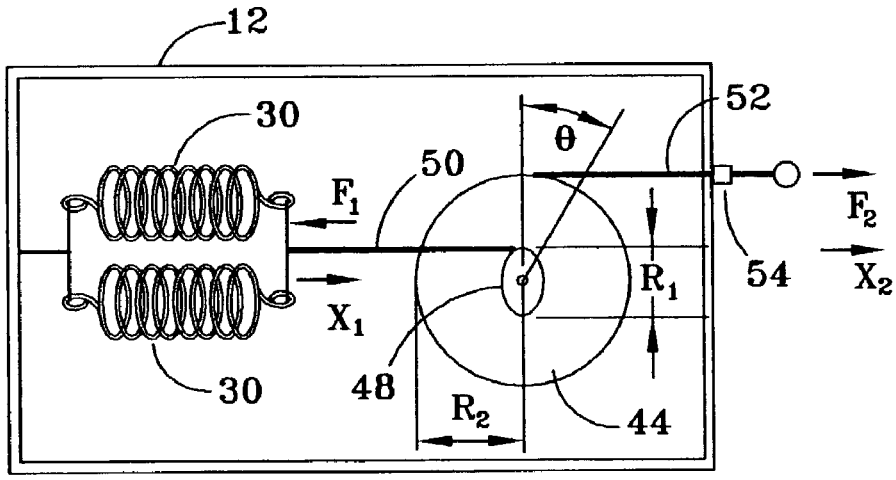
FIG. 4 depicts the forces acting on a shaft with a large diameter portion and a smaller diameter portion including a cam.

FIG. 4 shows a far better approach to maintaining the initial value of $F_2$ throughout the stroke. The smaller drum is replaced by a cam 48 (shown symbolically) specifically designed to maintain the force $F_2$ at its initial value. Equations 4 through 10 show the development of the design equations for this cam. Note that these equations allow for more than one spring, in a parallel arrangement, with N being the number of springs used. The force/stroke graph for this system using the cam shows a constant force over a range of displacements.

FIG. 5 shows an example of the cam shape which is obtained using Equation 10. The shape calculated by Equation 10 does not take into account certain second order effects such as a change in the point of contact of cable on the cam caused by angle change, etc. Therefore, the actual cam design may be modified to compensate for these effects. If the cam is planar (occupies a single plane), the rotation of the cam (and thus the drum) is limited to less than 1 complete revolution. If desired, the cam can be designed as a helix, so that multiple revolutions can be accommodated. The entire cam surface with multiple revolutions may still satisfy Equation 10 and thus accurately compensate for the varying spring force to obtain a constant force during the stroke length for the exercise equipment.

Determining the Required Energy Storage Capacity of the Springs

Figure 6:
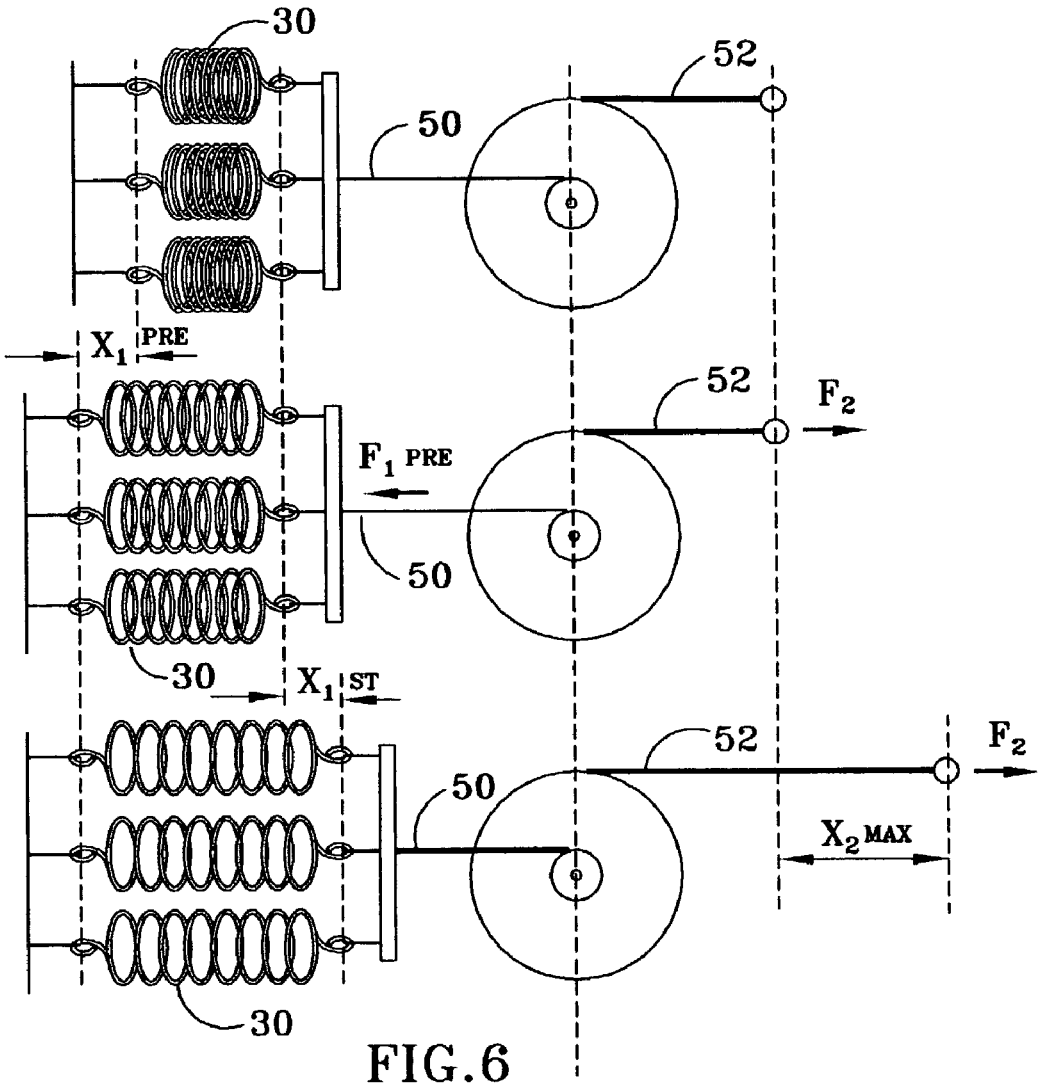
FIG. 6 illustrates three springs at a relaxed length, a preload condition, and a maximum stroke condition.

FIG. 6 conceptually shows the process of pre-loading, and stroking and identifies certain parameters used to calculate the energy storage requirement and in the design of the cam. In the top embodiment, the springs 30 are relaxed at their free length. For the middle embodiment, the springs are preloaded, in this case by spring elongation rather than compression. In the bottom embodiment, the springs 30 have now been stroked to a maximum length; thereby further lengthening the springs 30 in response to the force exerted by the user. Equation 11 shows the relationship between maximum work and these parameters. The spring assembly is capable of storing this maximum total work while having a reasonable fatigue life (many load cycles). Equation 12 shows the relationship between $F_{1PRE}$ and $F_2$ which involves the A parameter, defined in Equation 13. Equation 14 expresses the maximum work in terms which include A. Equation 15 shows how A can be derived based on the total stiffness $K_{TOT}$, $F_{2MAX}$, and maximum stroke $X_{2MAX}$. For a given $R_2$ and A, Equation 16 shows how the required $R_{1INIT}$ can be calculated. The design of the spring assembly to store the maximum total work requires a choice for the maximum allowable shear stress which the springs can endure with reasonable fatigue life.

The Concept of Spring Capture as the Method of Load Selection

Figure 7A:
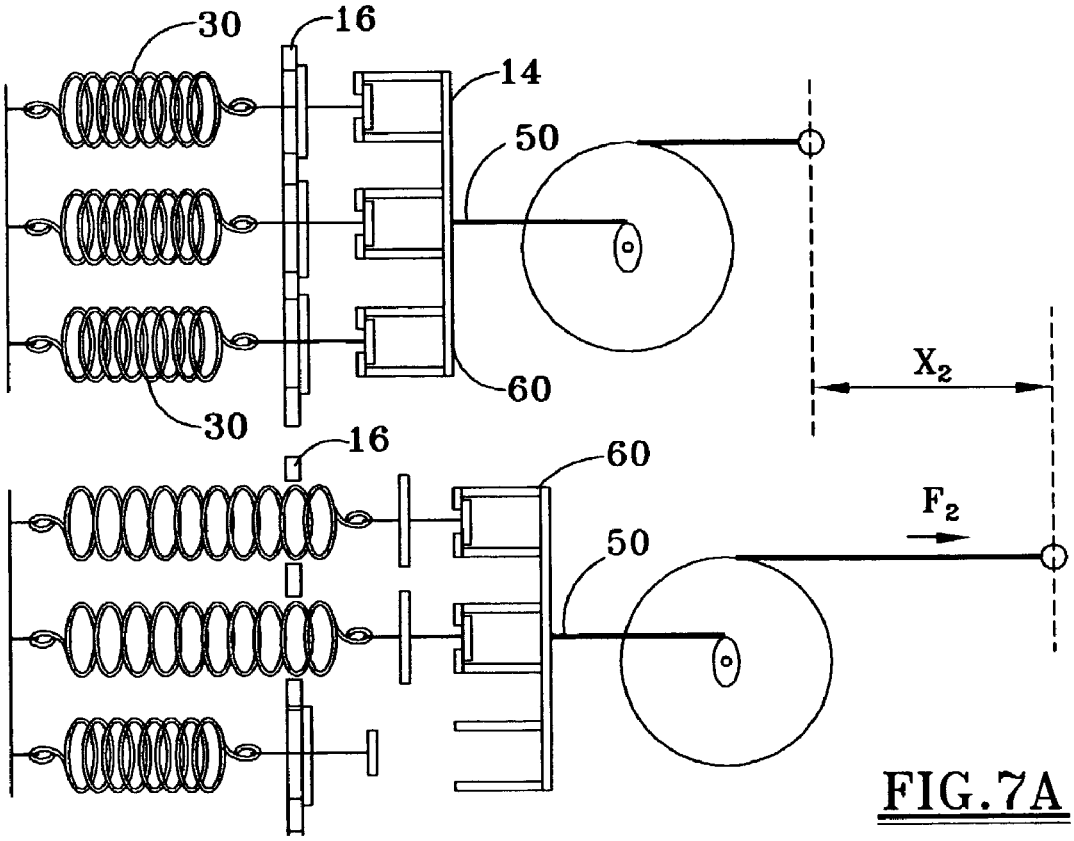
FIGS. 7A and 7B depict a plurality of the springs in an initial position and an outward position, with two springs selected for engagement in the upper embodiment and one spring captured in a lower embodiment.
Figure 7B:
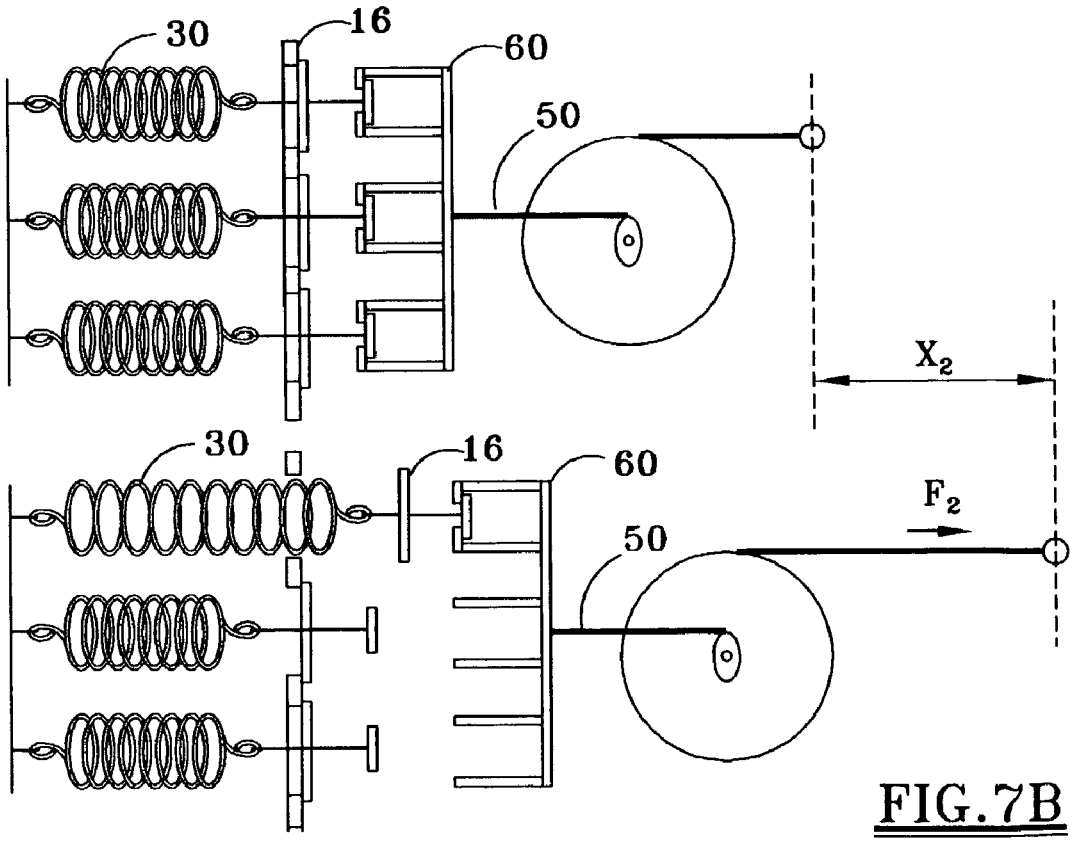

Equation 10 shows that the cam design is applicable only to a specific value of spring pre-load stretch $X_{IPRE}$. This precludes the concept of changing $X_1$PRE as a means of selecting the load. However, N, the number of springs in parallel, does not enter into Equation 10 and the cam design works for any number of springs in parallel. This suggests that the load selection should be accomplished by some type of spring capture mechanism, which changes the value of N. This approach provides another benefit compared to altering $X_{1PRE}$, which can be a laborious and time consuming process (turning a crank handle, etc.). With the use of the spring capture mechanism, the springs are already preloaded to the correct value. FIGS. 7A and 7B show the principle of operation.

A design of the capture mechanism is quite different from what is shown schematically in FIGS. 7A and 7B. Dealing with the principle and not the details of its implementation, FIGS. 7A and 7B show three springs 30 which are held in the pre-loaded configuration by a base plate. Even when the springs are not captured for recruitment in the stroking action, they are maintained in this pre-loaded condition. In FIG. 7B, the capture mechanism 60 has recruited one spring for participation in the stroke. Notice that prior to the beginning of the stroke, $F_2$ is zero because the spring force is opposed by the base plate. At the onset of the stroke, the capture mechanism pulls the captured spring away from its seated position on the base plate, and force is exerted on the cam. In actual implementation, at least one spring preferably is always applying its pre-load to assure that the cables are maintained under tension. Accordingly, the range of load selection may not extend down to zero. In the case of the exercise equipment, the minimum load may be, e.g., 10 pounds. In FIG. 7A, two springs have been captured. The force/stroke graph will show that, in this case, the load $F_2$ is twice the value obtained when one spring was captured.

Design Considerations for Low Energy Loss

As discussed above, the ability to achieve constant load throughout the stroke (both outward and inward stroke components) depend upon the ability of the system to store the stroke work in the potential energy of the springs during the outward stroke component, and then return this energy to the person during the inward stroke component. To the extent that energy is lost irreversibly to heat, the device will fail to hold the force constant. Therefore, care should be taken in the design to minimize friction and other energy loss mechanisms. Important causes of energy loss include:

1. Energy Loss Associated with the use of Visco-Elastic Material Instead of Steel as the "Spring" Component Visco-elastic material such as rubber (natural or synthetic) can endure much higher strain than steel without permanent deformation. This means that the allowable energy storage density (per unit volume) of rubber is much higher than steel. Accordingly, in many applications, visco-elastic materials are used instead of steel. However, a considerable amount of the energy cannot be recovered and is lost as heat. This energy loss is not due to friction per se but instead involves slippage and rearrangement of the long chain molecules which make up the polymer. The energy loss is manifested as a hysteresis-loop in the force/stroke diagram. Other manifestations are the "creep" and "stress relaxation" observed when the material is placed under tension. Actually visco-elastic materials exhibit no well defined "stiffness" and there is no stable relationship between stretch and the resulting force.

Figure 8:
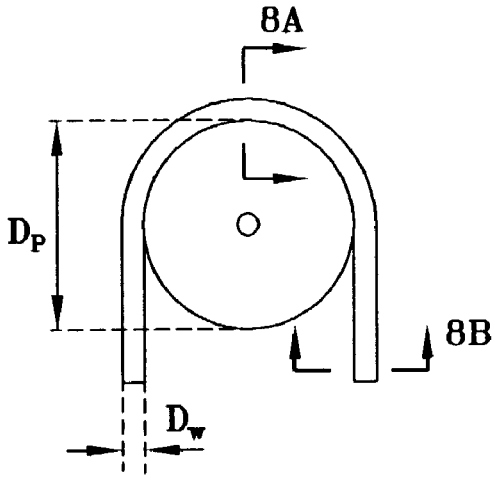
FIG. 8 illustrates the diameter of a wire rope or cable passing over a drum due to flattening compression.
Figure 8A:
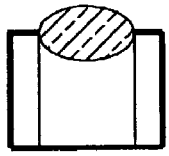
FIG. 8A shows the rope or cable deformed in cross section.
Figure 8B:
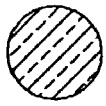
FIG. 8B shows the normal circular cross section for the rope or cable.

2. Deformation of Wire Rope Cable on a Pulley or Drum:

FIG. 8 illustrates the deformation of a wire rope cable due to the lateral pressure of contact against a pulley or drum. Usually, the pulley has a groove which is shaped to support the wire rope in a "cradle". In spite of this support, the wire rope undergoes a change in shape which rearranges the individual filaments, and a significant amount of potential energy is converted to heat. FIG. 8A shows the wire rope filaments under high load, wherein the filaments rub and slide past one another inside the bundle due to flattening compression. The circular cross section in FIG. 8B will be retained when the rope or cable is not engaging the pulley, regardless of the pull force on the cable. This problem obviously is more serious if the wire rope is under high load. Another important factor is the ratio of the diameter of the pulley or drum divided by the diameter of the wire rope: Dp/Dw. A larger value of $D_p/D_w$ will reduce this energy loss and also increase the number of available cycles (fatigue life) of the wire rope.

3. Bearing friction

Figure 9:
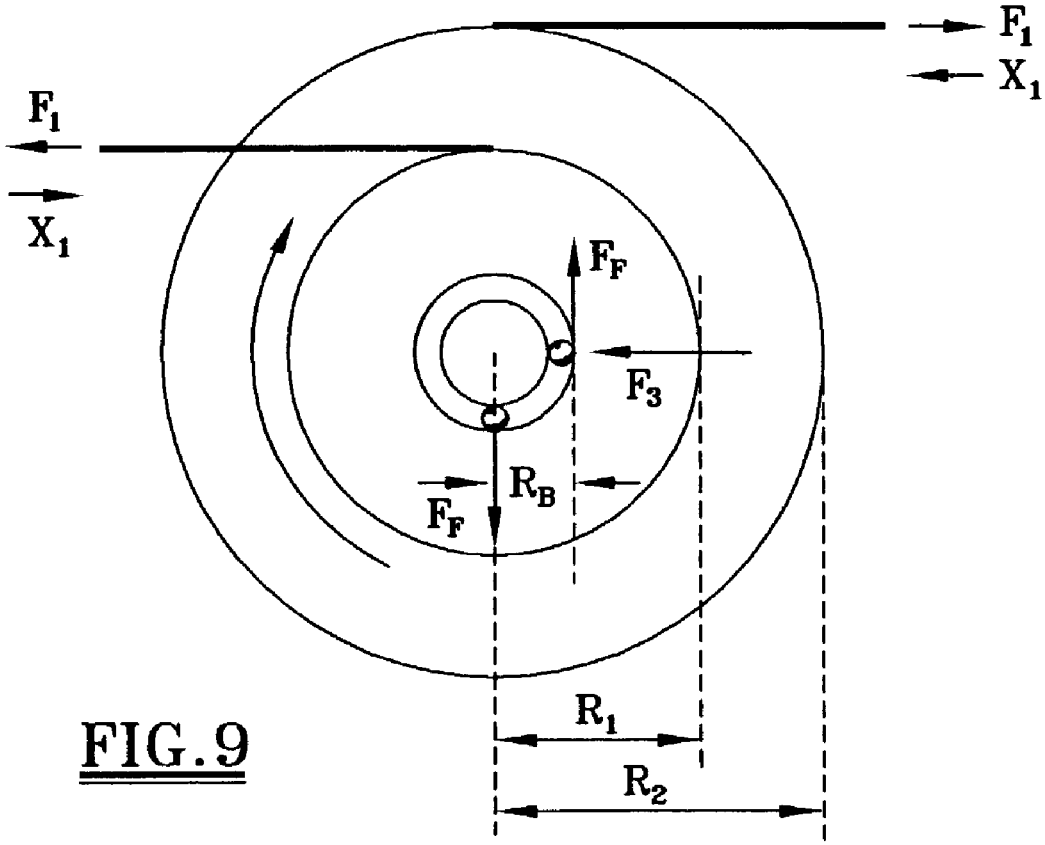
FIG. 9 illustrates the forces relevant into Equation 10.

Another very important source of energy loss is bearing friction. This friction arises from rolling and sliding and is quite complicated. The rolling friction is associated with the slight deformation of the ball bearing caused by Hertzian contact stress. The viscosity of the lubricant is another source of energy loss. This discussion will focus on the rolling friction as an example of a load dependent friction. FIG. 9 shows a pulley which is used to reverse the direction of pull of a cable. This is an important component of many designs because it can greatly reduce the size of the entire apparatus. The figure shows only two ball bearings as the ones primarily reacting to the applied load. This is done for clarity of illustration, and also as a simplification of the analysis, which is therefore only approximate. The work loss for bearing friction is provided in Equation 17. As shown in FIG. 9, a single ball bearing holds the net force of the cables, with force $F_B$. This ball bearing exerts a tangential friction force FF which opposes rotation. This friction force is proportional to the load, with the proportionality constant called the coefficient of rolling friction and labeled as β in Equation 17. The tangential friction force must be balanced by an equivalent force acting radially on another ball bearing, as indicated in the figure. This radially acting force will itself produce another tangentially acting friction force, but this is a very minor second order effect and is ignored in this development. Equation 17 shows that the work lost to heat is proportional to the work done by force $F_1$ with the proportionality constant being dependent on the coefficient of friction and the "ratio of radii" $R_R$, defined in Equation 18. This ratio of radii is important in the design of low friction equipment. It should be made as large as possible in order to reduce the effects of friction produced at the outer bearing race. In a design, the use of pulleys is avoided altogether.

Figure 10:
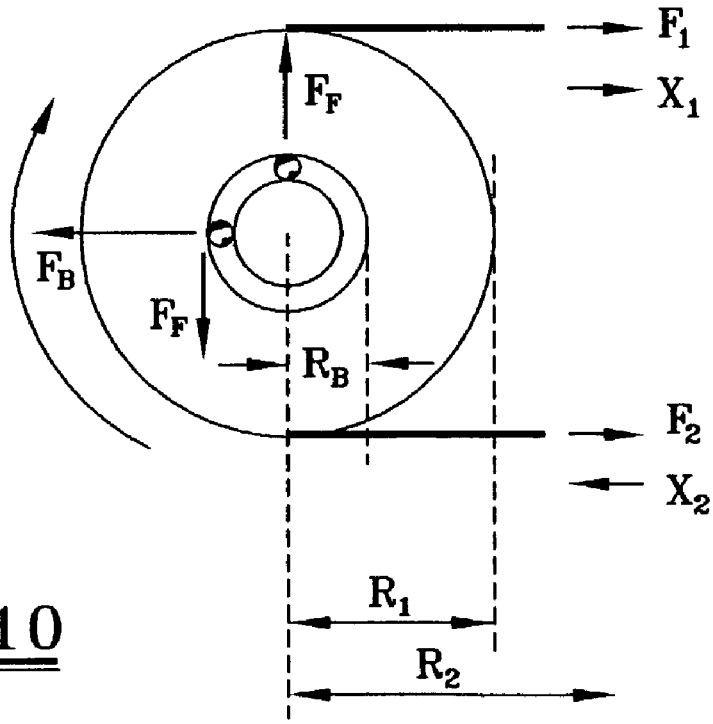
FIG. 10 illustrates the forces relevant to Equation 11.

FIG. 10 shows bearing friction on a compound drum. Again, the analysis is simplified by including only the primary effects on the two ball bearings which react most directly to the load. Equation 19 shows the work loss term as being proportional to the work done by $F_1$ The constant of proportionality in this case is shown to be dependent on the coefficient of friction β, a ratio of radii RR defined as shown in Equation 20, and an additional term, the A parameter. This A parameter is the same as defined in Equation 13 for a cam, with $R_{1INIT}$ being simply $R_1$. The vertical bars around the A-1 term in Equation 19 indicate "absolute value". The fact that the loss goes to zero when A=1 is due to the fact that when A is 1, $R_1$ is equal to $R_2$ and no net force is exerted on the bearing. In reality some friction will still be present, but not within the assumptions made in the development of Equation 20. Here we see the importance, once again of the ratio of radii $R_R$, which should be as large as possible to minimize the effect of bearing friction. The A parameter also greatly influences the effect of the bearing friction, with larger values producing larger energy loss. This is one of the practical limitations on the maximum value of A.

The Design of the RED/SLD

Having discussed several important concepts and considerations, the conceptual design of the actual hardware will be discussed. The figures show the concept for the exercise equipment in a schematic manner. FIGS. 1 and 2, for example, show only the primary components of the resistive exercise device, including the base plate, the load plate and load selection template. The figures are generally not to scale and are not engineering drawings.

Figure 11:
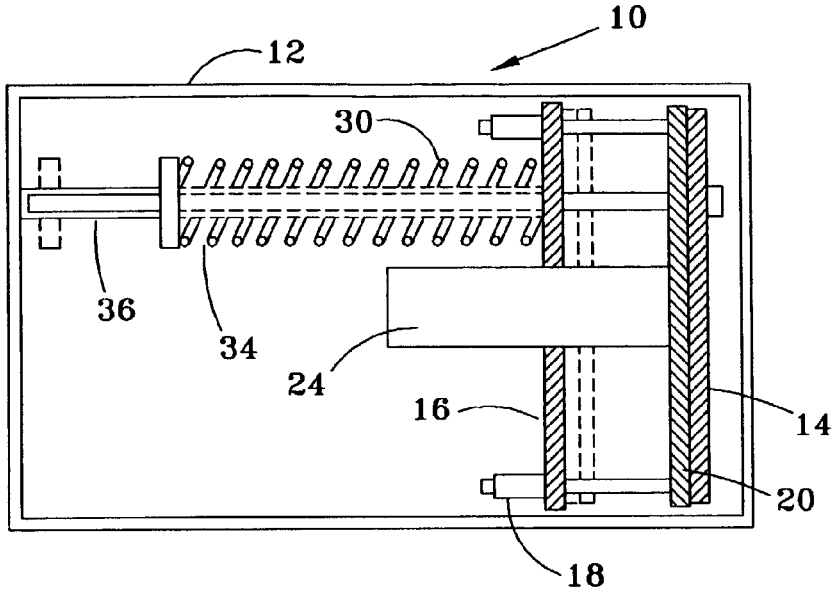
FIG. 11 illustrates a resistive exercise device shown in FIG. 1 in the stroked position.

The design shown in FIG. 11 thus corresponds to the design of FIG. 1, with the compression springs being stroked to exert energy when moving from the FIG. 1 position to the FIG. 11 position. Again, only one spring is shown for simplicity, and the use of a single coil spring as a resistance element may be considered inefficient, since the unused volume between the coils is essentially wasted space. Accordingly, nested coil springs 30A and 30B each surrounding support rod 70 may be used, as shown in FIG. 25, for obtaining a more compact exercise device. While the resistive elements have been discussed above as extension springs, compression springs can also be used as the energy storage element. There are three main advantages in the use of compression springs:

1. The pre-loaded compression spring occupies a smaller length dimension than an equivalent extension spring. This is because the pre-loading of a compression spring is a shortening of length, instead of an increase in length as for an extension spring.
2. Compression springs can be stacked end to end without the penalty of length associated with the end hooks which are present on each end of an extension spring.
3. Compression springs can be nested concentrically more easily than extension springs, because there are no hooks on the ends.

The design of the equipment should be approached with emphasis on high energy storage volume density due to dimensional constraints. A cylindrical spring (of either the extension or compression type) has a large open region inside the coils which is wasted volume. The loss of this available volume cannot be afforded in any design, which seriously attempts to maximum energy storage density, e.g., one coil spring within the central cavity in another larger coil spring, are preferred.

Figure 12:
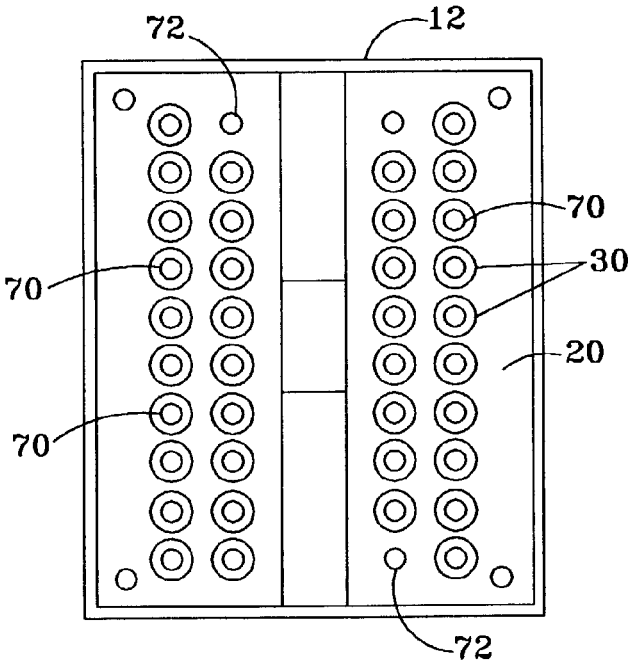
FIG. 12 illustrates an end view of an exercise device with multiple springs and respective stroke rods.
Figure 13:
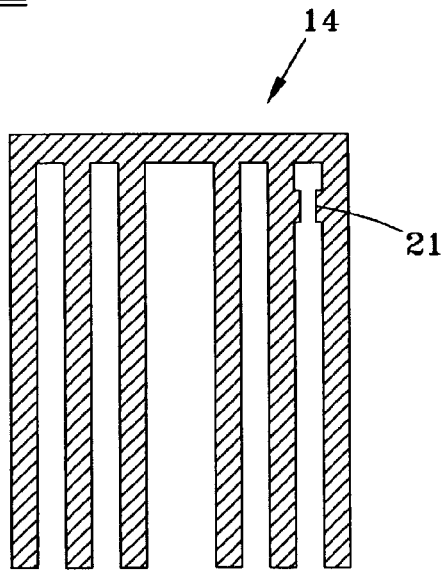
FIG. 13 illustrates one embodiment of a load plate.
Figure 19:
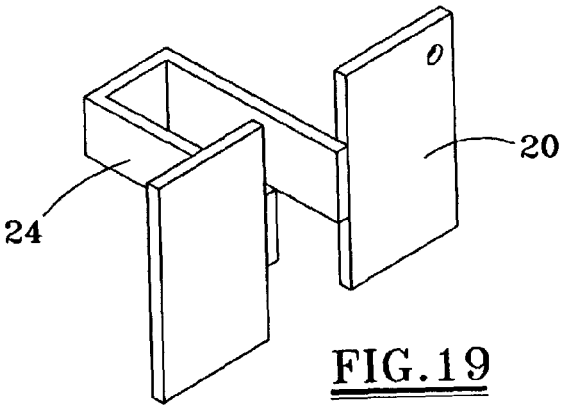
FIG. 19 illustrates the load plate in an isometric view.

The equipment may use a plurality of spring assemblies, each assembly composed of four concentrically nested compression springs, assembled on a spring support tube. While a single spring assembly is shown in most of the figures for clarity of illustration, FIG. 12 shows typical spring assemblies as end views. The coil springs 30 thus each surround a stroke rod 70. As shown in FIG. 12, two rods 72 are permanently captured to provide the initial, e.g., 10 lb, load. FIG. 19 depicts an isometric view of the load plate 20, which as previously discussed includes the generally U-shaped extension plate 24. Only one hole for a spring-stroke rod 70 is shown in the load selection template, but numerous holes generally will be provided for associated springs and stroke rods. FIG. 13 shows the load plate 20 in an isometric view. In FIG. 1, the pre-stroke position is shown.

Figure 20:
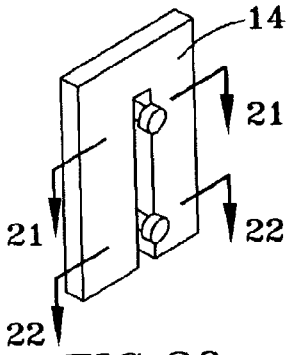
FIG. 20 is a side view of the load plate, load selection template, and spring stroke rod.
Figure 21:
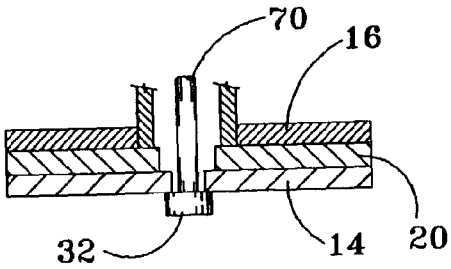
FIG. 21 is a cross-sectional view along lines 21—21 in FIG. 20 with the spring capture cap engaged by the load selection template with the cap able to pass through the load selection template, the load plate and the base plate.
Figure 22:
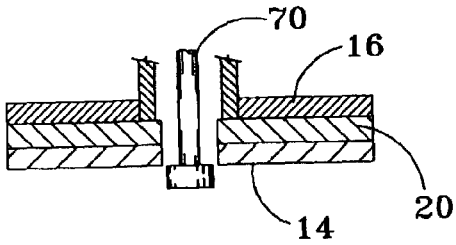
FIG. 22 illustrates the spring capture capsized to pull through the load plate and the base plate for disengagement from the respective spring.

The load selection template 14 cooperates with the capture mechanism 60 briefly discussed above. FIGS. 20–22 show further details of the capture mechanism. The load selection template 14 shown in FIG. 1 is configured for either engaging or not engaging the spring capture cap 72 on the end of a rod 70, so that the captured upper rod 70 and the spring 30 associated therewith move with the load plate 20 and the load selection template. The load selection template 24 is also configured for passing by selected spring capture cap 72, such as the lower rod in FIG. 20, so that movement of the load plate 20 and the load selection template 14 does not cause movement of the lower rod 70 shown in FIG. 22. FIG. 13 illustrates a neck region 21 configured to capture a cap on one stroke rod so that, as discussed above, at least one spring is always stroked even if no load selection template is used. The neck region 21 thus includes opposing tabs for engaging the rod. The initial setting on the exercise equipment, whether zero, 10 lbs, or more, is set at the discretion of the equipment designer.

Figure 14:
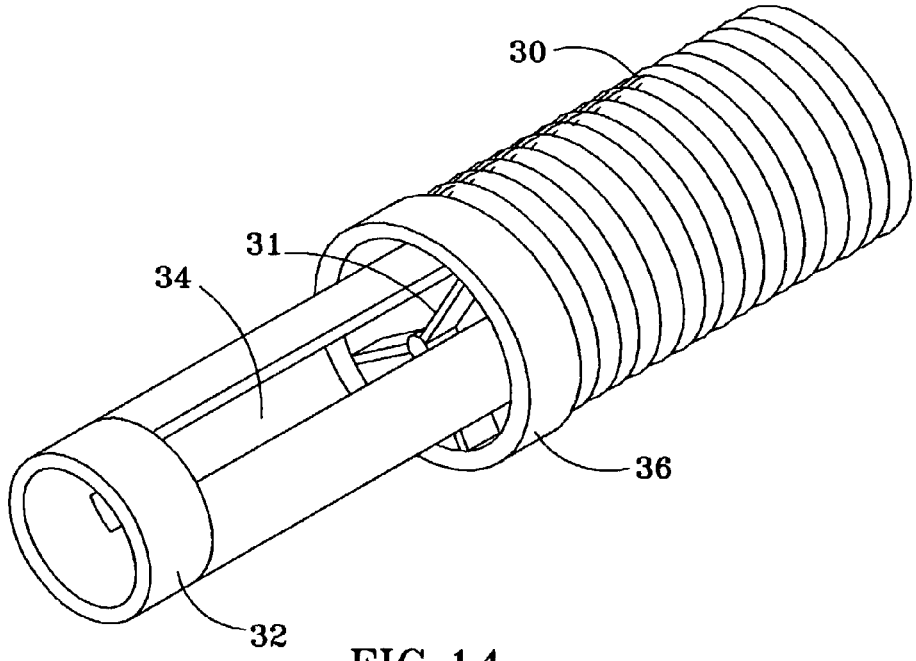
FIG. 14 is a pictorial view of a coil spring surrounding a slotted support tube.
Figure 15:
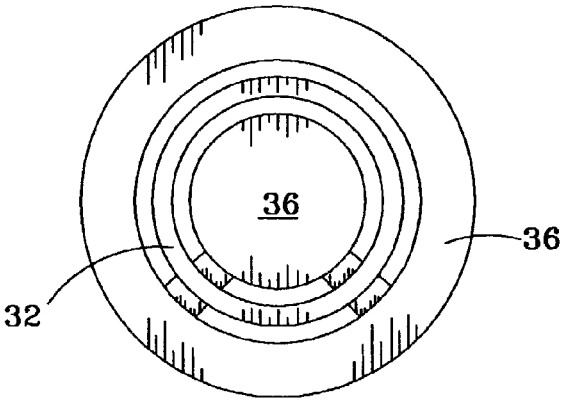
FIG. 15 is an end view of the spring and support tube shown in FIG. 14.
Figure 16:
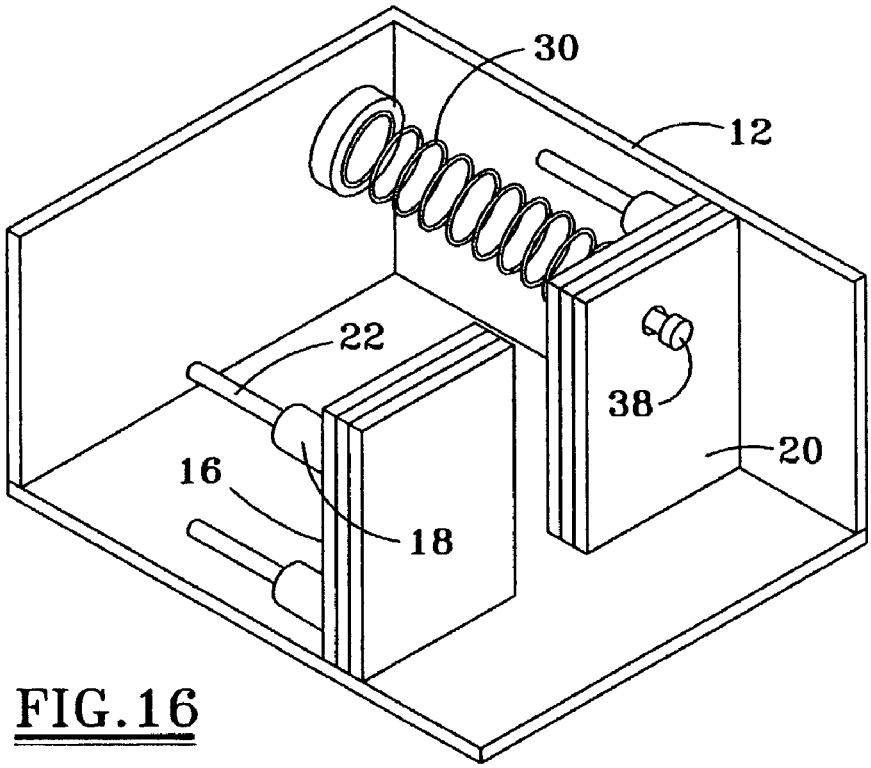
FIG. 16 illustrates the embodiment of an exercise device shown in FIGS. 1 and 11 with the load plate positioned against the base plate.
Figure 17:
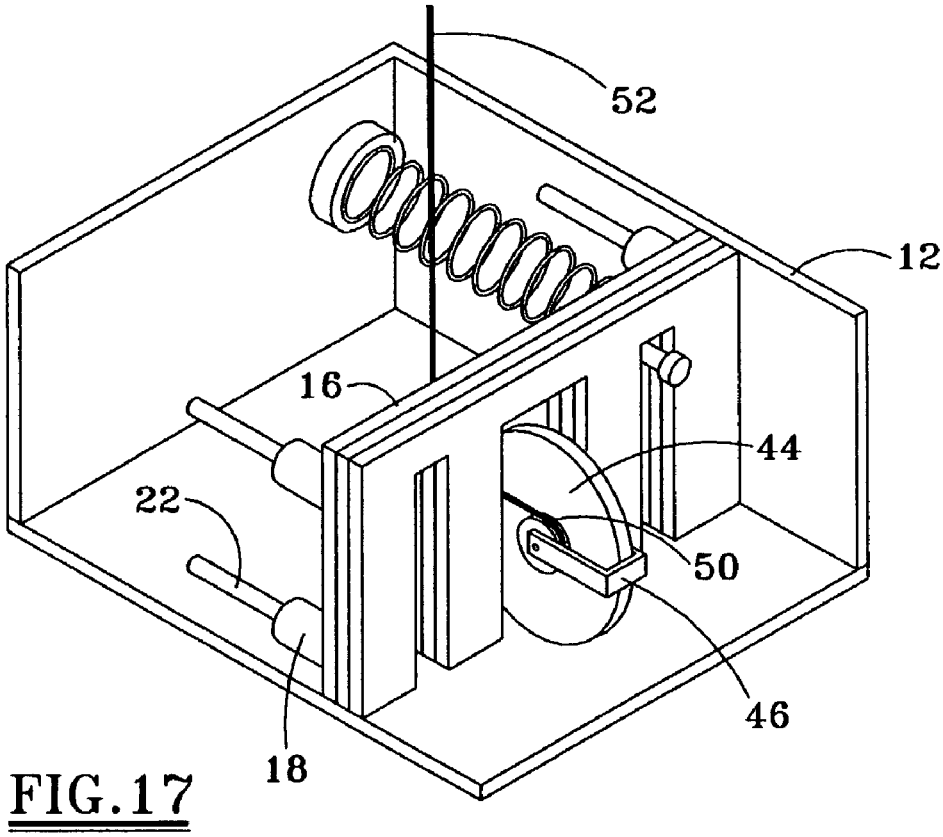
FIG. 17 illustrates the exercise device shown in FIG. 2 with the load plate positioned against the base plate.

The spring support tube 32 is shown in FIG. 14. The radial relationships between the spring support tube, spring stroke rod and stroke cap are shown in FIG. 15. FIG. 2 shows a cut-away partial view, indicating the presence of the lanyard wheel 44, cam 48 and lanyard wheel bracket 46. FIGS. 16 and 17 show partial isometric views which are helpful in understanding FIGS. 1 and 2. The lanyard wheel bracket 22 may be bolted or otherwise secured to an end wall of the enclosure 12. Upward movement of the cable 52 rotates the lanyard wheel 44, thereby pulling on the cam cable 50 and compressing the spring 30.

FIG. 23 is an isometric view of the support tube 32 with a slot 34, as discussed above. A fixed end 35 of the support tube may be externally threaded for screwing into the base plate, although various attachment mechanisms may be used to fix the support tube to the base plate. Bolt holes 37 are provided for securing end plug 39 within the support tube. The end plug 39 includes a threaded bolt hole 41 for bolting the end plug to a wall of the enclosure 12.

FIG. 14 depicts three stroke attachment bars 31 which are connected to the spring stroke rod 70, and pass through a respective slot 34 in the support tube 32, thereby interconnecting the rod 70 with the spring stroke cap 36, which is at the free end of the coil spring 30.

Figure 18:
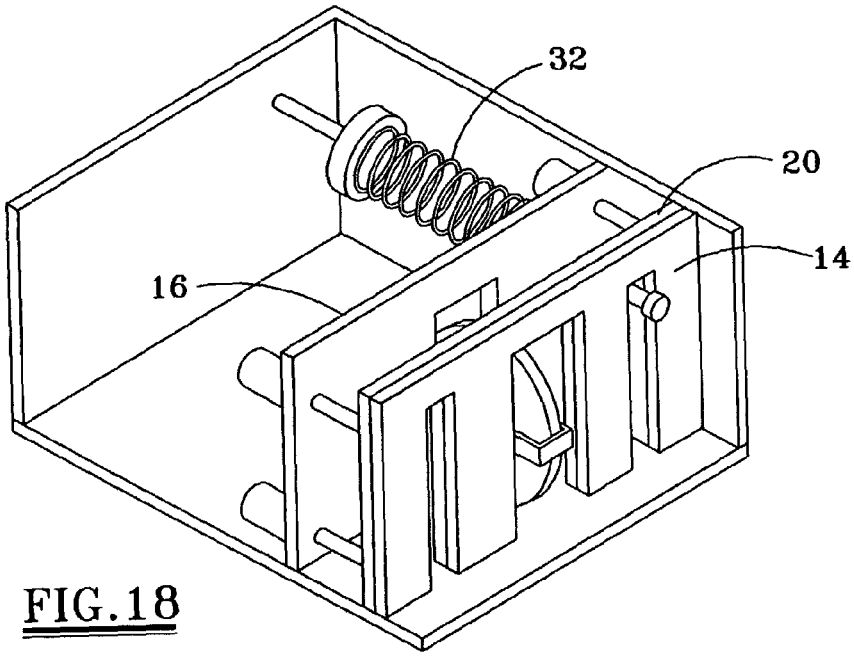
FIG. 18 illustrates in further detail a cable operated exercise device shown in FIG. 17 in the stroked position.

FIG. 11 shows the exercise equipment 10 as shown in FIG. 1 in the full stroke configuration. FIG. 18 shows an isometric illustration which is helpful in understanding FIG. 11. FIGS. 12 and 13 show end views of the load plate 20 and load selection template 14 which can be studied in conjunction with FIGS. 20 and 21 to understand the spring capture mechanism. Note in particular in FIG. 12 that two spring capture caps are permanently captured by the load plate. The length of the spring stroke rods for these two springs is such that their pre-load force is constantly exerted on the load plate. While not shown in the figures, the lanyard wheel cable preferably includes a mechanical stop discussed above, which holds the exercise equipment at the zero stroke position against the selected pre-load so that the load plate never touches the base plate.

FIG. 24 depicts exercise device 10 according to the present apparatus with component size being representative for an enclosure 12, which conveniently could have a height from 6 to 10 inches and a length from 20 to 36 inches. Again, only the primary components of the exercise device are depicted. Compared to the upper at rest position, the cable 52 has been pulled for the lower exercise device which may either compress or extend a spring, exerting a substantially constant force over a substantial range of displacement. As shown in this figure, the radius of the pulley or lanyard wheel is substantially greater than a maximum radius of a cam profile, and preferably the pulley radius is at least twice the maximum radius of the cam profile. As explained above, the cam surface profile may be calculated and machined to precisely neutralize the increasing force of the springs and produce a flat force-displacement curve characteristic of free weights on Earth.

Various modifications to the embodiment discussed above will be suggested to those skilled in the art. As previously indicated, various types of user interfaces may be used as force applying mechanisms for applying the applied force to move the load transfer member. A handle or bar may thus be a suitable force applying mechanism for doing arm exercises, while a harness worn on the torso of the user may be used for cooperation with a treadmill, which may be powered or non-powered. The harness thus transmits to the cable the applied force which moves the load transfer member during use of the exercise device.

Figure 26:
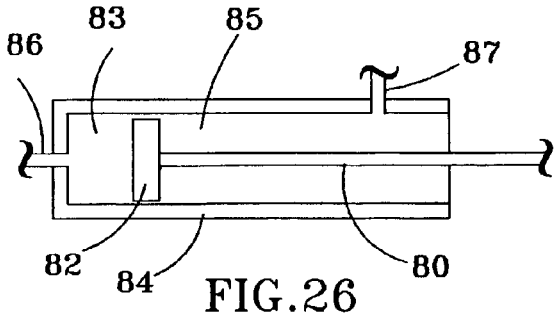
FIG. 26 depicts a piston rather than a spring as a resistance element.

While coil springs are an embodiment of a resistance element, an alternative embodiment may use a piston or a plurality of pistons in parallel, to replace the plurality of coil springs. FIG. 26 depicts a piston 82 linearly moveable within the piston housing 84, with piston rod 80 being similar in function to spring rod 70. Movement of the piston as shown in FIG. 26 thus disperses fluid out the line 86, and preferably into the chamber 85 through line 87. During the axially opposing movement of the piston 82, fluid thus flows out the line 87 and into the chamber 83 via line 86. If desired, one or more fluid restrictions (not shown) may be provided for regulating the force required to move the piston 82. Use of the piston as shown in FIG. 26, particularly coupled with a plurality of pistons in parallel, may obviate the need for a cam surface, the exercise otherwise is similar to the embodiment with a plurality of coil springs.

In other embodiments, an applied force from the powered motor may be used to selectively increase the force required for movement of the load transfer member. During the inward or return portion of the stroke, the force may thus be selectively increased, e.g., gradually up to a value of 10% or 20%, then gradually decreased, so that the applied force for the motor is only available during the inward or return portion of the stroke, while no additional force may be used during the outward or eccentric motion of the stroke. The applied motor thus applies a predetermined torque to only a portion of the stroke. Various sensors may be used to conventionally allow the motor to determine the position of the rod 70, 80 with respect to the frame, so that the desired amount of torque can be supplied in a uniform manner to the desired portion of the stroke.

Various types of user interfaces may be used to move the transfer member, such as a handle that is represented in FIG.

2. A harness transfer may also be used so that, for example, the back of the harness was connected to the cable when the user walks on a treadmill, with the cable effectively operating as a selectable load which exerts a constant force on the user during the exercise.

Another feature of the apparatus is that the exercise includes a shaft with a cam that is part of the load transfer member. A small motor for applying and releasing an additional force to the shaft rotating about axis 45 as shown in FIG. 5 thus allows for adjusting the eccentric/concentric motion, so that the return stroke is, e.g., 10% or 20% higher than the eccentric extend stroke. The exercise device will allow the motor to exert an increasing force on the return stroke, which may be adjusted during portions of the return stroke, so that the user desirably exerts more force on the return stroke than the extend stroke.

FIG. 26 depicts the use of a piston rather than a spring as the selected resistant element. Piston 82 is axially movable in housing 104, and is sealed to the housing to separate chamber 83 from chamber 85. A force that is exerted on piston rod 80 while pushing the fluid through lines 86 and 87 and between the chambers 83 and 85. A fluid flow restriction (not shown) may also be used along the flow lines or at the ports to the chambers 83 and 85.

The term "low gravity" as used herein should be understood in its broadest sense to mean an environment which provides gravity less than that of the earth. Obviously in a very low gravity (microgravity) or no-gravity environment, use of the equipment as disclosed herein clearly compensates for the loss of gravity. In a low gravity environment, such as the moon, the known gravity in which the exercise equipment will be operated allows the equipment fabricator to make the necessary adjustment, so that, for example, 80% of the desired resistive force is obtained by movement of the resisted elements, and 20% of the desired resistive force is obtained by the low gravity environment.

Various other modifications to the exercise equipment as disclosed herein should be apparent from the above description of the embodiments. Although the apparatus has thus been described in detail for these embodiments, it should be understood that this explanation is for illustration, and that the apparatus is not limited to these embodiments. Alternate components and installation techniques will be apparent to those skilled in the art in view of this disclosure. Additional modifications are thus contemplated and may be made without departing from the spirit of the apparatus, which is defined by the claims.

$$\frac{F_2}{F_1} = \frac{R_1}{R_2} \quad \text{Eq. 1}$$

$$\frac{X_2}{X_1} = \frac{R_1}{R_2} \quad \text{Eq. 2}$$

$$\frac{K_2}{K_1} = \left[\frac{R_1}{R_2}\right]^2 \quad \text{Eq. 3}$$

Cam Design Equations For N Springs in Parallel:

$$F_2 = \frac{F_1 R_1}{R_2} = \frac{NK_1(X_1 + X_{1PRE})R_1}{R_2} \quad \text{Eq. 4}$$

Where: $X_{1PRE}$ is the pre-load stretch of the spring and N is the number of springs in parallel $$DF_2 = 0 = \frac{NK(X_1 + X_{1PRE})dR_1}{R_2} + \frac{NKR_4 dX_1}{R_2} \quad \text{Eq. 5}$$

$$X_1 = \int R_1 d\theta \quad \text{Eq. 6}$$

$$dX_1 = R_1 d6 \quad \text{Eq. 7}$$

$$\frac{dR_1}{d\theta} = \frac{-R_1^2}{(X_1 + X_{1PRE})} \quad \text{Eq. 8}$$

$$X_2 = R_2 6 \quad \text{Eq. 9}$$

$$R_1 = \int\left[\frac{-R_1^2}{X_1 + X_{1PRE}}\right]d\theta + R_{1INIT} \quad \text{Eq. 10}$$

Where $R_{1INIT}$ is the initial $R_1$ radius, when θ is zero, and where $X_1$ is simultaneously calculated using Eq. 6. The shape of the cam is calculated for a specific value of $X_{1PRE}$. Eq. 4 shows that, holding the $NK_1$ product constant, the cam will work only for the corresponding specific value of $F_2$. Eq. 4 also shows that, for a given $K_1$ and $X_{1PRE}$, $F_2$ can be adjusted by changing N, the number of springs participating in the stroke. Eq. 10 does not involve N.

$$W_{MAX} = \frac{1}{2}K_{TOT}X_{1MAX}^2 = W_{PRE} + W_{ST} = \frac{1}{2}K_{TOT}X_{1PRE}^2 + F_{2MAX}X_{2MAX} \quad \text{Eq. 11}$$

Where: (See FIG. 13)

$W_{MAX}$ is the maximum total work done $K_{TOT}=NK_1$ is the stiffness of all the springs (in parallel)

$X_{1MAX}=X_{1PRE}+X_{1ST}$ $X_{1PRE}$ is the stretch applied to the springs during the pre-load $X_{1ST}$ is the stretch applied to the springs during the maximum stroke $W_{PRE}$ is the work done during the pre-load WST is the maximum stroke work $F_{2MAX}$ is the maximum selectable $F_2$×

$X_{2MAX}$ is the maximum stroke through which $F_{2MAX}$ acts $$F_{1PRE} = \frac{R_2}{R_{1INIT}}F_2 = AF_2 \quad \text{Eq. 12}$$

$$\text{Where: } A = \frac{R_2}{R_{1INIT}} \quad \text{Eq. 13}$$

$$W_{MAX} = \frac{F_{2MAX}^2}{2K_{TOT}}A^2 + F_{2MAX}X_{2MAX} \quad \text{Eq. 14}$$

Work Loss Equations for Bearing Friction:

For a Pulley:

$$W_L = W_1\left[\frac{2\beta}{R_R+\beta}\right] \quad \text{Eq. 15}$$

See Appendix A for development of this equation

Where:

$W_L$ is work lost due to bearing friction for a pulley $W_1$ is the work done by $F_1$ $\beta$ is the coefficient of rolling friction $$R_R = \frac{R}{R_B} \quad \text{Eq. 16}$$

$R_R$ is the "ratio of radii" for a pulley.

For a Compound Drum:

$$W_L = W_1\left[\frac{\beta|A-1|}{R_R+\beta}\right] \quad \text{Eq. 17}$$

See Appendix A for development of this equation.

Where:

$$R_R = \frac{R_2}{R_B} \quad \text{Eq. 18}$$

$R_R$ is the "ratio of radii" for the compound drum $$A = \frac{R_2}{R_1} \quad \text{Eq. 19}$$

|A-1| means "absolute value of" A-1

$\beta$ is the coefficient of rolling friction $W_L$ is the work lost due to bearing friction for the compound drum $W_1$ is the work done by $F_1$.

What is claimed is:

1. A resistive exercise device, comprising:

a frame;

a plurality of resistance elements each supported on the frame, each resistance element having a supported end attached to the frame and a free end opposite the supported end, the free end being movable relative to the supported end in response to an applied force provided by a user and wherein each of the plurality of resistance elements is a linear resistance element whose force increases substantially linearly over a displacement range of the free end relative the supported end;

a load transfer member, movable relative to the frame, for transferring the applied force to the free end of the at least one resistance element;

a load selection template removably securable to the load transfer member;

a plurality of capture mechanisms, each selected capture mechanism engaging the free end of a corresponding resistance element, such that the applied force to the load transfer member moves the load transfer member to displace the free end of each engaged resistance element; and a force applying mechanism for applying the applied force to move the load transfer member.

2. A resistive exercise device, comprising:

a frame;

a plurality of resistance elements each supported on the frame, each resistance element having a supported end attached to the frame and a free end opposite the supported end, the free end being movable relative to the supported end in response to an applied force provided by a user;

a load transfer member, movable relative to the frame, for transferring the applied force to the free end of the at least one resistance element;

a load selection template removably securable to the load transfer member;

a plurality of capture mechanisms, each selected capture mechanism engaging the free end of a corresponding resistance element, such that the applied force to the load transfer member moves the load transfer member to displace the free end of each engaged resistance element; and a force applying mechanism for applying the applied force to move the load transfer member, wherein the force applying mechanism comprises:

a pulley having an axis stationary with respect to the frame;

an elongate flexible member coupled with the pulley and secured to the load transfer member; and a user interface secured to the flexible elongate member for engagement by the user to provide the applied force to the force applying mechanism.

3. A resistive exercise device defined in claim 2, wherein the force applying mechanism comprises:

a cam rotatable about an axis fixed to the frame and interconnected with the load transfer member.

4. A resistive exercise device as defined in claim 3, further comprising:

another flexible elongate member coupling the cam to the load transfer member, such that the applied force to the flexible elongate member cable rotates the cam to move the load transfer member.

5. A resistive exercise device as defined in claim 4, wherein a profile of the cam negates an increasing force of each captured resistance element to maintain a substantially constant applied force to the load transfer member over a displacement range of the free end relative to the fixed end.

6. A resistive exercise device as defined in claim 5, wherein the profile of the cam negates the increasing force over a displacement range of each captured resistance element satisfies the relationship:

$$R_1 = \int\left[\frac{-R_1^2}{X_1+X_{1PRE}}\right]d\theta + R_{1INIT}$$

where $R_{1INIT}$ is the initial $R_1$ radius when $\theta$ is zero, where $X_1=\int R_1 d\theta$, and the shape of the cam is calculated for a specific value of $X_{1PRE}$.

7. A resistive exercise device, comprising:

a frame;

a plurality of resistance elements each supported on the frame, each resistance element having a supported end attached to the frame and a free end opposite the supported end, the free end being movable relative to the supported end in response to an applied force provided by a user, wherein each of the plurality of resistance elements is a coil spring, and wherein the coil spring is a compression spring;

a load transfer member, movable relative to the frame, for transferring the applied force to the free end of the at least one resistance element;

a load selection template removably securable to the load transfer member;

a plurality of capture mechanisms, each selected capture mechanism engaging the free end of a corresponding resistance element, such that the applied force to the load transfer member moves the load transfer member to displace the free end of each engaged resistance element; and a force applying mechanism for applying the applied force to move the load transfer member wherein the applied force compresses the coil spring.

8. A resistive exercise device as defined in claim 1, wherein the plurality of resistive elements are supported in parallel on the frame, and selected resistive elements are nested in other of the plurality of resistive elements.

9. A resistive exercise device as defined in claim 1, wherein each of the plurality of resistance elements is a piston displaced by a substantially constant force over a range of displacement.

10. A resistive exercise device as defined in claim 1, further comprising:

a stroke rod secured to the free end of each of the plurality of resistance elements, the stroke rod having a cap end for capture by a respective capture mechanism and a neck region substantially more narrower than the cap end.

11. A resistive exercise device as defined in claim 10, wherein the capture mechanism comprises opposing tabs having a spacing wider than the neck region and narrower than the cap end, such that the opposing tabs engage the cap end of the stroke rod.

12. A resistive exercise device as defined in claim 1, wherein each of the plurality of resistance elements is pre-loaded between one end stationary with respect to the frame and an opposing end stationary with respect to a spring end cap.

13. A resistive exercise device as defined in claim 1, wherein the force applying mechanism comprises:

a pulley having an axis stationary with respect to the frame;

an elongate flexible member coupled with the pulley and the load transfer member;

a user interface secured to the flexible elongate member for engagement by the user to provide the applied force to the force applying mechanism;

a cam rotatable about an axis fixed to the frame and interconnected with the load transfer member;

another flexible elongate member coupled with the cam, such that the applied force to the another flexible elongate member rotates the cam to move the load transfer member; and the pulley radius is at least twice a maximum radius of the cam profile.

14. A resistive exercise device, comprising:

a frame;

at least one resistance element supported on the frame, each resistance element having a supported end attached to the frame and a free end opposite the supported end, the free end being movable relative to the supported end in response to an applied force provided by a user;

a load transfer member, movable relative to the frame, for transferring the applied force to the free end of the at least one resistance element; and a force applying mechanism for applying the applied force to move the load transfer member, the force applying mechanism including a cam rotatable about an axis fixed to the frame and interconnected with the load transfer member, and a flexible elongate member coupling the cam to the load transfer member.

15. A resistive exercise device as defined in claim 14, wherein a profile of the cam negates an increasing force in the at least one resistance element to maintain a substantially constant applied force to the load transfer member over a displacement range of the free end relative to the fixed end.

16. A resistive exercise device as defined in claim 15, wherein the profile of the cam negates the increasing force over a displacement range of the at least one resistance element satisfies the relationship:

$$R_1 = \int \left[ \frac{-R_1^2}{X_1 + X_{1PRE}} \right] d\theta + R_{1INIT}$$

where $R_{1INIT}$ is the initial $R_1$ radius when $\theta$ is zero, where $X_1 = \int R_1 d\theta$, and the shape of the cam is calculated for a specific value of $X_{1PRE}$.

17. A resistive exercise device as defined in claim 14, wherein each of the at least one resistance element is a linear resistance element whose force increases substantially linearly over a displacement range of the free end relative the fixed end.

18. A resistive exercise device defined in claim 14, wherein the force applying mechanism comprises:

a pulley having an axis stationary with respect to the frame;

an elongate flexible member coupled with the pulley and the load transfer member; and a user interface secured to the flexible elongate member for engagement by the user to provide the applied force to the force applying mechanism.

19. A resistive exercise device as defined in claim 14, wherein each of the at least one resistance element is a coil spring and the coil spring is a compression spring, and the applied force compresses the spring.

20. A resistive exercise device as defined in claim 14, wherein the at least one resistance element comprises a plurality of resistive elements supported in parallel on the frame.

21. A resistive exercise device as defined in claim 14, further comprising:

the at least one resistance element comprising a plurality of resistance elements mounted in parallel to the frame; and a stroke rod secured to the free end of a respective resistance element, the stroke rod having a cap end for capture by a capture mechanism and a neck region substantially more narrow than the cap end.

22. A resistive exercise device as defined in claim 21, wherein the capture mechanism comprises opposing tabs having a spacing wider than the neck region and narrow than the cap end, such that the opposing tabs engage the cap end of the stroke rod, and wherein each of the plurality of resistance elements is pre-loaded between one end stationary with respect to the frame and on opposing end stationary with respect to a spring end cap.

23. A resistive exercise device, comprising:

a frame;

at least one resistance element supported on the frame and having a free end movable in response to an applied force;

an elongate flexible member secured to the at least one resistance element for applying a force to the resistance element;

a cam having a cam axis stationary with respect to the frame and coupled to the free moveable end, wherein a profile of the cam negates an increasing force of the resistance element and maintains a relatively constant tensile force on the flexible member through a range of displacement of the free end of the resistance element; and a force applying mechanism engaging the cam profile for applying the applied force to move the at least one resistance elements.

24. A resistance exercise device as defined in claim 23, wherein a profile of the cam satisfies the relationship:

$$R_1 = \int \left[ \frac{-R_1^2}{X_1 + X_{1PRE}} \right] d\theta + R_{1INIT}$$

where $R_{INIT}$ is the initial $R_1$ radius when $\theta$ is zero, where $X_1 = \int R_1 d\theta$, and the shape of the cam is calculated for a specific value of $X_{1PRE}$.

25. A resistive exercise device as defined in claim 23, further comprising:

a plurality of differently sized interchangeable cams, each cam providing a corresponding level of constant force displacement to operate the resistive exercise device, such that a user may select a desired level of constant-force displacement by selecting the interchangeable cam.

26. A resistive exercise device as defined in claim 23, wherein the at least one resistance element comprises a plurality of resistive elements supported in parallel on the frame.

27. A resistive exercise device as defined in claim 23, wherein the at least one resistance element is a piston displaced by a substantially constant force over a range of displacement.

28. A resistive exercise device as defined in claim 23, wherein the at least one resistance element is a constant force spring displaced by a substantially constant force over a range of displacement.

29. A resistive exercise device as defined in claim 23, further comprising:

a stroke rod secured to the free end of the at least one resistance element, the stroke rod having a cap end for capture by a capture mechanism and a neck region substantially more narrow than the cap end.

30. A resistive exercise device as defined in claim 23, wherein the capture mechanism comprises opposing tabs having a spacing wider than the neck region and narrow than the cap end, such that the opposing tabs engage the cap end of the stroke rod.

31. A resistive exercise device as defined in claim 23, wherein the at least one resistance element is pre-loaded between one end stationary with respect to the frame and an opposing end stationary with respect to a spring end cap.

* * * * *